US008513592B2

(12) United States Patent
Taniguchi

(10) Patent No.: US 8,513,592 B2
(45) Date of Patent: Aug. 20, 2013

(54) ION TRAP MASS SPECTROMETER

(75) Inventor: Junichi Taniguchi, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 0 days.

(21) Appl. No.: 13/585,623

(22) Filed: Aug. 14, 2012

(65) Prior Publication Data

US 2013/0082171 A1 Apr. 4, 2013

(30) Foreign Application Priority Data

Sep. 29, 2011 (JP) ..... 2011-214339

(51) Int. Cl.
*H01J 49/26* (2006.01)

(52) U.S. Cl.
USPC ..... 250/281; 250/282; 250/283; 250/290; 250/291

(58) Field of Classification Search
USPC ..... 250/281, 282, 283, 290, 291
See application file for complete search history.

(56) References Cited

U.S. PATENT DOCUMENTS 6,124,592 A * 9/2000 Spangler ..... 250/287
6,870,159 B2 * 3/2005 Kawato ..... 250/292
7,176,456 B2 * 2/2007 Kawato ..... 250/292
7,193,207 B1 * 3/2007 Ding et al. ..... 250/292
7,683,316 B2 3/2010 Takeshita et al. ..... 250/292
7,755,034 B2 7/2010 Ding ..... 250/283
2002/0000784 A1 * 1/2002 Shamoto et al. ..... 318/801
2008/0035841 A1 * 2/2008 Ding ..... 250/283
2008/0277580 A1 * 11/2008 Takeshita et al. ..... 250/292
2009/0032698 A1 * 2/2009 Furuhashi et al. ..... 250/282
2009/0278042 A1 * 11/2009 Izumi et al. ..... 250/287
2010/0116982 A1 * 5/2010 Iwamoto et al. ..... 250/292

FOREIGN PATENT DOCUMENTS

JP 2007-527002 9/2007
JP 2008-282594 11/2008

* cited by examiner

*Primary Examiner* — Michael Logie
(74) *Attorney, Agent, or Firm* — Bingham McCutchen LLP

(57) ABSTRACT

An ion trap mass spectrometer with high sensitivity for detection in the high mass-to-charge ratio is provided. with separate measurement of square-wave voltages on the positive and negative electrode sides applied to a ring electrode in rectifying circuits and smoothing the measured voltages in integrating circuits, respectively, the areas of square-wave voltages on the positive and negative electrode sides are replaced with the peak values h1 and h2 of DC signals, respectively. A comparator circuit outputs the difference of said peak values as the error signal Δ, and variable delay circuits adjust the amount of delay of control signals so that the error signal Δ becomes zero. This changes the relative phase relation between control signals on the positive and negative electrode sides that turn on and off the switches, and renders the duty ratio of square-wave voltages nearly 50%.

3 Claims, 10 Drawing Sheets

ION TRAP MASS SPECTROMETER

TECHNICAL FIELD

The present invention relates to an ion trap mass spectrometer with an ion trap that confines ions by the action of a high-frequency electric field and relates more specifically to an ion trap mass spectrometer using a digital-driven ion trap.

BACKGROUND ART

In an ion trap mass spectrometer, an ion trap is used to confine ions by the action of a high-frequency electric field to separate ions with a specific mass-to-charge ratio (m/z) and further to dissociate such separated ions. A typical ion trap is in 3D quadrupole configuration composed of one ring electrode the inside surface of which is a hyperboloid of revolution of one sheet and a pair of endcap electrodes the inside surface of which is a hyperboloid of revolution of two sheets that are disposed facing each other across said ring electrode. In addition, an ion trap in linear configuration composed of four rod electrodes disposed parallel to each other is also well-known. In this specification, for convenience, a "3D quadrupole configuration" is used as an example for explanatory purposes.

A conventional general ion trap, namely, an analogue-driven ion trap, applies a sinusoidal high-frequency voltage to a ring electrode, forms a high-frequency electric field for trapping ions in a space surrounded by a ring electrode and endcap electrodes, and then traps ions in said space while keeping such ions vibrating by the action of the high-frequency electric field. On the other hand, a newly developed ion trap applies to a ring electrode a square-wave voltage instead of a sinusoidal high-frequency voltage for trapping ions (see, among others, Patent Literature 1 and 2 and Non-patent Literature 1). The ion trap of this kind is called a 'digital-driven ion trap', or simply a 'digital ion trap ("DIT") as a square-wave voltage with two different voltage levels, high and low, is generally used.

FIG. 7 is a schematic configuration diagram showing a drive in a conventional DIT FIG. 8 is a timing diagram of this drive. As shown in FIG. 7, the ion trap 3 consists of one electrode 31 and a pair of endcap electrodes 32 and 34, and the ring electrode 31 is connected the positive electrode side high-voltage DC power supply 55 and the negative electrode side high-voltage DC power supply 56 via the positive electrode side switch 53 and the negative electrode side switch 54, respectively. The switches 53 and 54 are high-voltage switching devices such as a power MOSFET. The positive electrode side switch 53 and the negative electrode side switch 54 are turned on and off by the control signals on both positive and negative electrode sides provided from a control unit not shown in the figure (see FIGS. 8 (*a*) (*b*)). A short-circuit occurs when both switches 53 and 54 are turned on at the same time. To avoid this, a blank period when both control signals are off is set between the period when control signals on the positive electrode side are on and the period when control signals on the negative electrode side are on. It may be supposed that when such control signals are applied, the square-wave voltage applied to the ring electrode 31 will take, as shown in FIG. 8 (*c*), different levels of voltage, positive voltage (Vdd), negative voltage (−Vdd) and zero voltage; however, there is actually little change in voltage as the electric charges on the ring electrode are trapped when both switches 53 and 54 are off and thus, the shape of such square-wave voltage will be as shown in FIG. 8 (*d*).

As is seen from FIG. 8, the square-wave voltage applied to the ring electrode 31 becomes a positive voltage (Vdd) for the period TA from the time when control signals on the positive electrode side become on to the time when control signals on the negative electrode side become on, and becomes a negative voltage (−Vdd) for the period TB from the time when control signals on the negative electrode side become on to the time when control signals on the positive electrode side become on. Therefore, if the periods TA and TB are identical, the duty ratio of the square-wave voltage becomes 50%. However, if the period TA becomes different from the period TB due to a gap in the timing of both control signals, or if there are variations in switching characteristics (response time, etc.) of both switches 53 and 54 even when the periods TA and TB are identical, the duty ratio of the square-wave voltage deviates from 50%.

In the DIT, if the duty ratio of a square-wave voltage applied to the ring electrode 31 deviates from 50%, the following problems will occur.

(1) The change of the duty ratio of the square-wave voltage will alter the shape of the stability region in the diagram of stability region for trapping ions that is drawn based on the stability condition for the solution of the Mathieu equation even where there is no change in frequency of the square-wave voltage or any other related factors (see FIG. 2 of Non-patent Literature 2). Under such condition, ions with a high mass-to-charge ratio are likely to escape from the stability region and thus, such ions cannot be confined in the ion trap. FIG. 9 shows an example mass spectrum measured with a mass spectrometer using the DIT, and (b) shows the case where the duty ratio of the square-wave voltage is 50% and (a) shows the case where the duty ratio deviates from 50%. It is clear that in (a), ions with a mass-to-charge ratio of 600 or more are not detected.

(2) As shown in FIG. 2 of Non-patent Literature 2, the relation between the value q and the value β, important parameters for the ion trap, changes with a change in the shape of the stability region in the stability region diagram. This gives rise to a larger difference between the theoretical mass-to-charge ratio of target ions to be trapped and the mass-to-charge ratio of ions actually trapped in the ion trap, and therefore, the correction of such difference (mass calibration) deviates from the theoretical value.

FIG. 10 shows the obtained correction (variation) values of value q when the duty ratio of a square-wave voltage is deviated by 0.3% from 50%. If the original value q is large, the correction values and the mass-dependence are small, but it can be observed that the smaller the value q gets, the larger the correction values and the mass-dependence become. If this gap becomes larger and, in particular, the mass-dependence becomes larger, it becomes more difficult to accurately trap the target ions with a desired mass-to-charge ratio in the ion trap, which then reduces the selectivity of precursor ions, for example.

The 0.3% deviation of the duty ratio assumed in making FIG. 10 referred to above is only for 1.8 nsec if the period of a square-wave voltage is 600 nsec (the frequency is 1.67 MHz). Such minor time lag can be easily caused by characteristic changes, due to the temperature and other factor, of ICs such as drivers and buffers used for a transmission line to provide control signals to operate the switches 53 and 54 and also the switches themselves. Therefore, the problem about the mass calibration referred to above can happen frequently.

PATENT LITERATURE

Patent Literature 1: Japanese Translation of PCT International Application Publication No. 2007-527002

Patent Literature 2: Japanese Unexamined Patent Application Publication No. 2008-282594

NON-PATENT LITERATURE

Non-patent Literature 1: Furuhashi and six others, "Development of digital ion trap mass spectrometer", Shimadzu Hyoron (Shimadzu Review), Shimadzu Hyoron Hensyubu, Mar. 31, 2006, vol. 62, Nos. 3-4, pp. 141-151

Non-patent Literature 2: Won-Wook Lee and six others, "Stability of ion motion in the quadrupole ion trap driven by rectangular waveform voltages", International Journal of Mass Spectrometry, 230, 2003, pp. 65-70

SUMMARY OF THE INVENTION

The present invention is made to solve the problems referred to above. The main purpose of the invention is, in the ion trap mass spectrometer using the DIT, to ensure that ions with a high mass-to-charge ratio are also trapped in the ion trap and to avoid losing the peak of a maximum mass-to-charge ratio on a mass spectrum, by preventing the deviation of the duty ratio of a square-wave voltage applied to a ring electrode from 50%. Another purpose of this invention is to provide an ion trap mass spectrometer that can enhance mass selectivity by minimizing the deviation of mass calibration of the ion trap from the theoretical value.

In the present invention made to resolve the problems referred to above, the ion trap mass spectrometer is provided with an ion trap to confine ions in a space surrounded by three or more electrodes, includes a positive voltage DC power supply, a negative voltage DC power supply, a switch on the positive electrode side that turns on and off the positive voltage output from said positive voltage DC power supply and a switch on the negative electrode side that turns on and off the negative voltage output from said negative voltage DC power supply for applying the square-wave voltage for trapping ions to at least one of said electrodes, and comprises a square-wave voltage generation means for outputting said square-wave voltage by using the positive and negative voltages supplied through each of said switches on both positive and negative electrode sides when such switches are on, wherein the ion trap mass spectrometer comprises:

a) a positive electrode side waveform area calculation means for calculating the area of the square-wave voltage on the positive electrode side that is applied to at least one of said electrodes;

b) a negative electrode side waveform area calculation means for calculating the area of the square-wave voltage on the negative electrode side that is applied to at least one of said electrodes; and c) a feedback adjusting means for adjusting the timing of change of at least one of the control signals that turn on and off said switches on the positive and negative electrode sides in order to level the areas calculated by said positive electrode side waveform area calculation means and negative electrode side waveform area calculation means.

The ion trap of the ion trap mass spectrometer pertaining to the present invention is a 3D quadrupole ion trap or linear ion trap, In the case of 3D quadrupole ion trap, at least one of said electrodes is a ring electrode. On the other hand, the linear ion trap is composed of four rod electrodes disposed parallel to each other, encircling the central axis, and two rod electrodes that are disposed facing each other across the central axis correspond to a ring electrode of the 3D quadrupole ion trap and other two rod electrodes correspond to a pair of endcap electrodes.

In the ion trap mass spectrometer of the present invention, the positive electrode side waveform area calculation means and the negative electrode side waveform area calculation means can respectively be configured to include a rectifying means for extracting a waveform on either the positive or negative electrode side from a bipolar square waveform and integrating means for integrating (smoothing) the rectified square waveform on either the positive or negative electrode side, respectively.

If the period from the rising edge (or the falling edge) of a square-wave control signal (control signal on the positive electrode side) that turns on and off a switch on the positive electrode side to the rising edge (or the falling edge) of a square-wave control signal (control signal on the negative electrode side) that turns on and off a switch on the negative electrode side corresponds to the positive electrode side of the square-wave voltage and if the period from the rising edge (or the falling edge) of a control signal on the negative electrode side to the rising edge (or the falling edge) of a control signal on the positive electrode side corresponds to the negative electrode side of the square-wave voltage, a feedback adjusting means can be configured to adjust the amount of delay of the control signal on either the positive or negative electrode side relative to the other in accordance with the difference between the areas calculated by the positive electrode side waveform area calculation means and the negative electrode side waveform area calculation means.

In the ion trap mass spectrometer of the present invention, due to ambient temperature changes or other factors, such as deviation of the duty ratio of a square-wave voltage from 50% caused by a difference in switching characteristics between switches on the positive and negative electrode sides, the difference between the areas calculated by the positive electrode side waveform area calculation means and the negative electrode side waveform area calculation means becomes nonzero. Then, the feedback adjusting means adjusts and changes, to restore the duty ratio of the square-wave voltage to 50%, the timing of change of the control signal on either of the positive and negative electrode sides so that the difference between the areas on the positive and negative electrode sides of the square-wave voltage becomes zero, that is, the both areas become identical. In short, the duty ratio of the square-wave voltage is controlled by the feedback loop.

The ion trap mass spectrometer of the present invention can maintain the duty ratio of a square-wave voltage applied to, for instance, the ring electrode of a 3D quadrupole ion trap at around 50% and therefore, can inhibit the deformation of a stability region diagram based on the stability condition for the solution of the Mathieu equation and can also trap ions with a high mass-to-charge ratio in the ion trap. This can avoid the disappearance of ion peaks at a high mass-to-charge ratio on a mass spectrum obtained by mass spectrometry for ions trapped in the ion trap and improve the detection sensitivity in the high mass-to-charge ratio range.

There is a well-known method to detect the deviation of the duty ratio of square-wave signals by computation with the use of much higher frequency square-wave signals, that is, by timing measurement. However, in the equipment of the present invention, the deviation of the duty ratio that is dealt with corresponds to the time of order of a few nsec and therefore, a detection circuit with an operation clock frequency of order of GHz or higher is necessary to detect such time by timing measurement, which is not practical. In contrast, the ion trap mass spectrometer of the present invention only requires to calculate and compare the areas on the positive and negative electrode sides of a square-wave voltage and therefore, has a simple hardware configuration and an economic advantage.

If there is a difference between the peak values (the absolute values of the voltages) of the output voltages of positive and negative voltage DC power supplies, the duty ratio will be adjusted so that the areas of the square-wave voltage on the positive and negative electrode sides become identical and thus, the duty ratio deviates from 50%. In other words, provided that a minor deviation of the duty ratio from 50% is permitted, the deformation of the stability region can be avoided to some extent and the detection sensitivity in the high mass-to-charge ratio range can be maintained at a high level even if there is a slight difference between the peak values of the square-wave voltage on the positive and negative electrode sides.

However, if there is a large difference between the peak values of the square-wave voltage on the positive and negative electrode sides, a change in the operating point within the stability region based on the stability condition for the solution of the Mathieu equation cannot be ignored and then, a deviation of mass calibration cannot be avoided. In a preferred embodiment of the ion trap mass spectrometer of the present invention, it is advantageous for the spectrometer to have additional peak value feedback adjusting means for feeding back and adjusting the voltages output from said positive and negative voltage DC power supplies so that the peak values of said square-wave voltage on the positive and negative electrode sides may become their respective predetermined value.

The function of said peak value feedback adjusting means thus equalizes the peak values of the square-wave voltage on the positive and negative electrode sides, and the function of said duty ratio feedback adjusting means adjusts the duty ratio of the square-wave voltage to 50%. This inhibits the deformation of a stability region diagram based on the stability condition for the solution of the Mathieu equation and further inhibits the change of the trap operating point within the stability region and thus, the deviation of mass calibration of an ion trap from the theoretical value can also be suppressed while enhancing the sensitivity of detection of ions with a high mass-to-charge ratio. Therefore, the mass selectivity is enhanced when trapping ions with a fixed mass-to-charge ratio in an ion trap as a precursor ion, for instance.

DETAILED DESCRIPTION OF THE INVENTION

Figure 1:
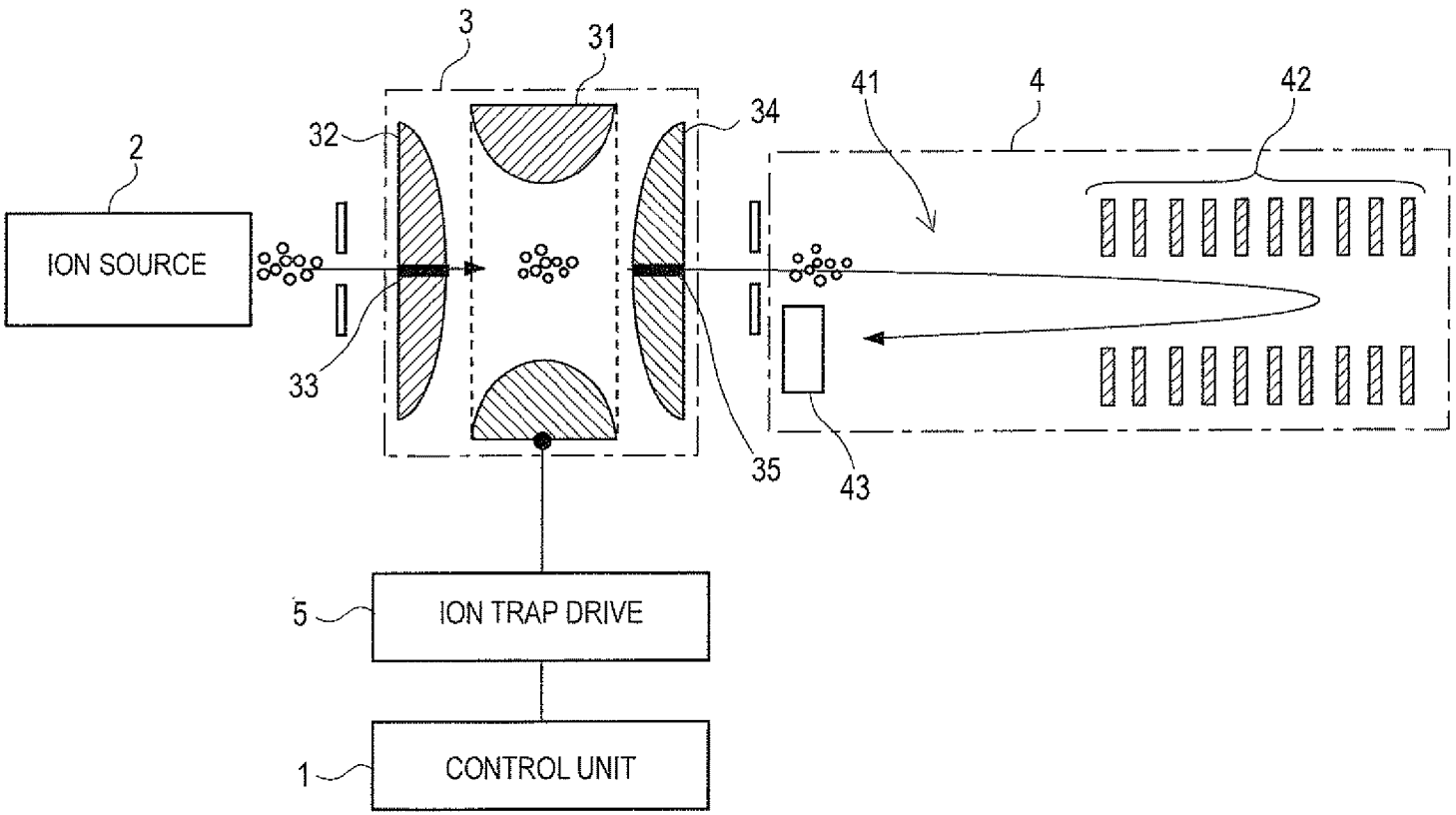
FIG. 1 shows a schematic view of the configuration of the DIT-TOFMS, the first embodiment of the ion trap mass spectrometer of the present invention.

The DIT-TOFMS, one embodiment of the ion trap mass spectrometer according to the present invention, is described next with reference to the attached figures. FIG. 1 shows a schematic view of the configuration of the DIT-TOFMS of the first embodiment.

The DIT-TOFMS of the first embodiment comprises: the ion source 2 that ionizes target specimens; the 3D quadrupole ion trap 3 that temporarily holds ions and manipulates such ions in various ways, such as mass separation and collision-induced dissociation; and the time-of-flight mass spectrometer 4 that detects ions emitted from the ion trap 3 after mass-separation.

No particular ionization method is specified in the ion source 2. For liquid specimens, atmospheric pressure ionization methods such as the electrospray ionization (ESI) method and the atmospheric pressure chemical ionization (APCI) method are used. For solid specimens, methods such as the matrix-assisted laser desorption/ionization (MALDI) method are used.

As described above, the ion trap 3 comprises one ring electrode 31, and the endcap electrode 32 on the entrance side and the endcap electrode 34 on the exit side that are disposed facing each other across said ring electrode 31, and the field for trapping ions is the space enclosed by these three electrodes 31, 32 and 34. The ion entrance aperture 33 is made approximately at the center of the endcap electrode 32 on the entrance side, and ions ejected from the ion source 2 are introduced into the ion trap 3 through the ion entrance aperture 33. Further, the ion exit aperture 35 is made approximately at the center of the endcap electrode 34 on the exit side, and ions emitted from the inside of the ion trap 3 through the ion exit aperture 35 are introduced to the time-of-flight mass spectrometer 4.

The time-of-flight mass spectrometer 4 includes the flight space 41 in which the reflectron 42 is disposed to reflect ions by an electrostatic field and the detector 43 to detect ions flying through the flight space 41. As the ion trap 3 itself has a function of mass separation and thus, it may also be configured to emit ions through the ion exit aperture 35 after mass separation in the ion trap 3 and directly detect such ions using the detector.

The ion trap drive 5 applies the square-wave voltage referred to below to the ring electrode 31 to drive the ion trap 3 under the control of the control unit 1, Further, voltages are also applied to the endcap electrodes 32 and 34 to cause resonance excitation of ions in the ion trap 3 or eject ions from the inside of the ion trap 3. This will, however, not be further described herein as it is not the spirit of the present invention.

Figure 2:
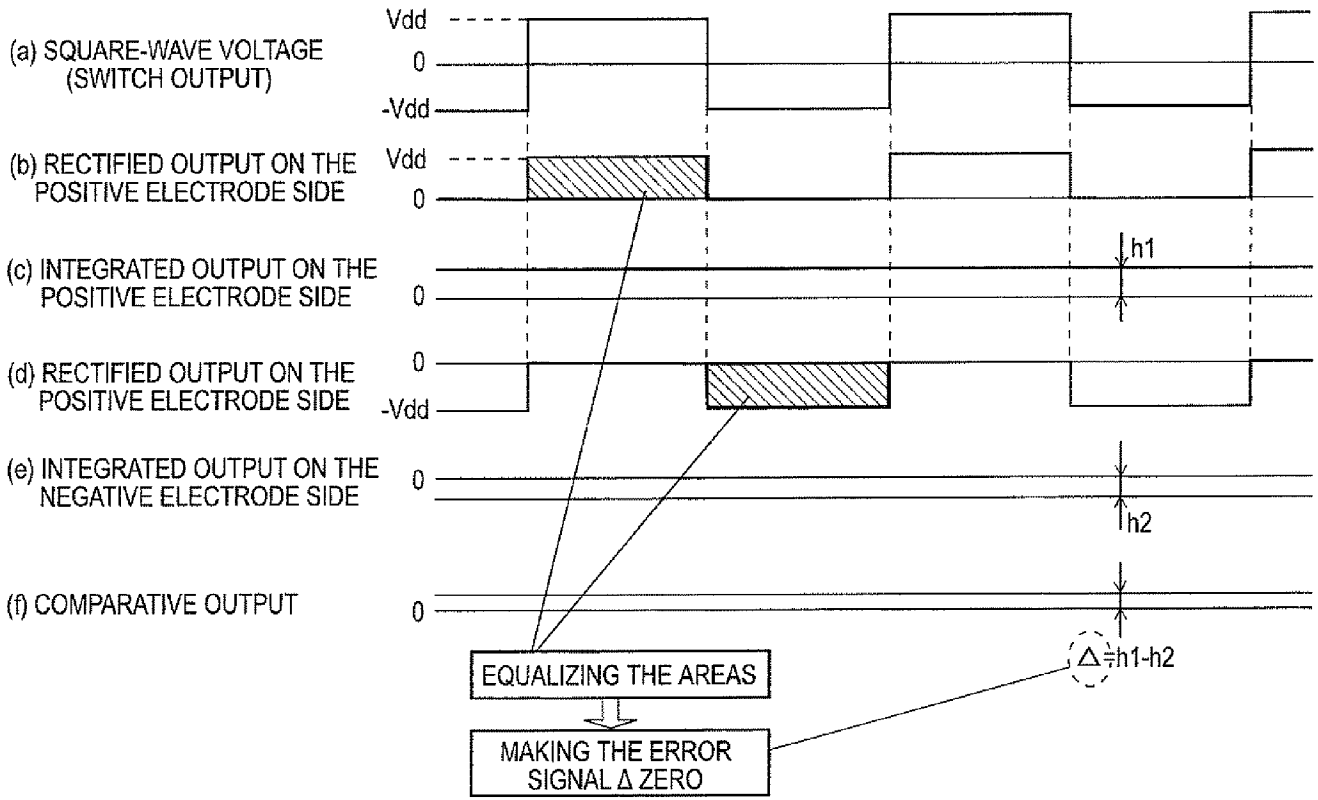
FIG. 2 shows a timing diagram showing the operation of the ion trap drive in the DIT-TOFMS of the first embodiment.
Figure 3:
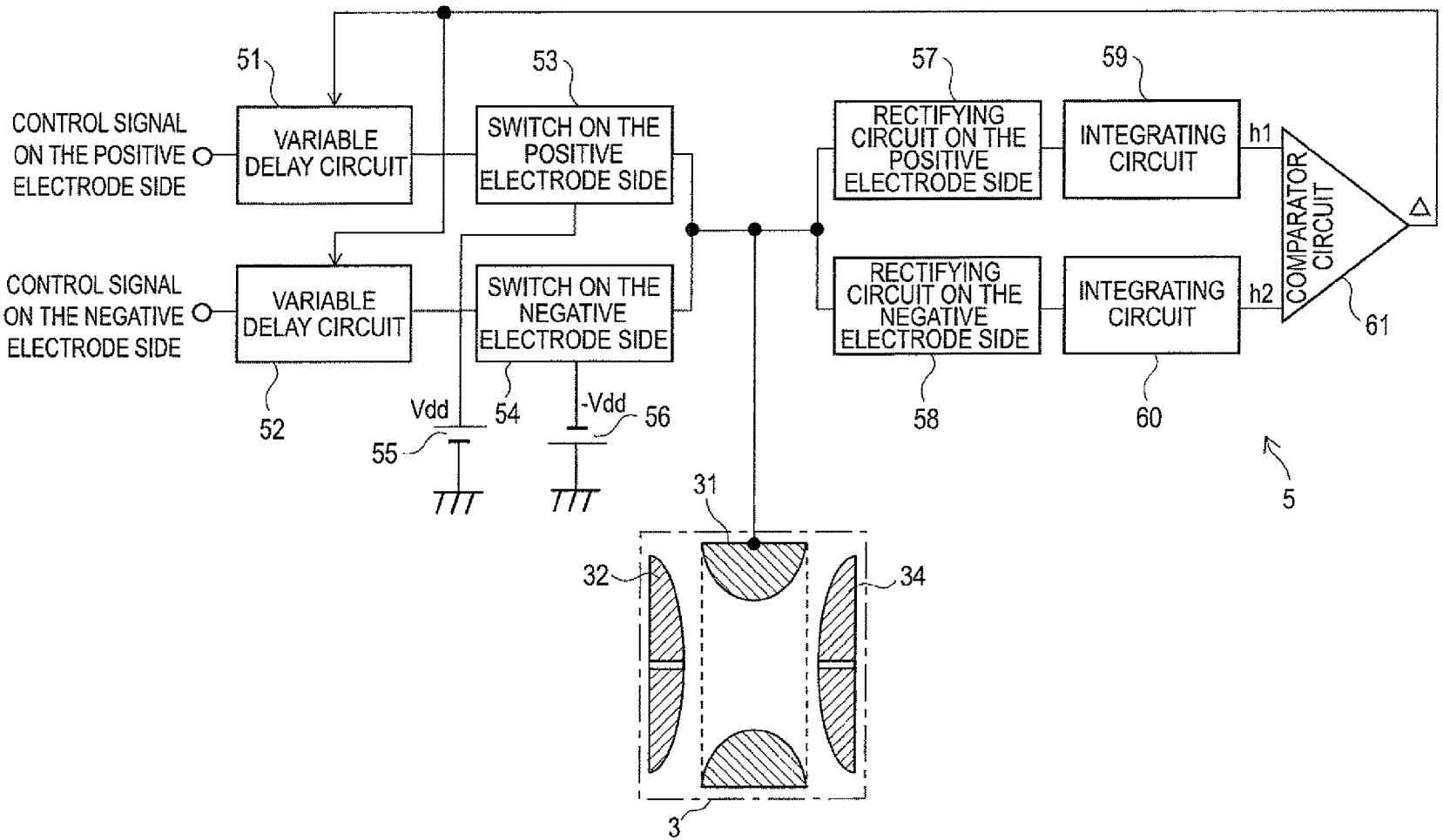
FIG. 3 shows a block diagram of the ion trap drive in the DIT-TOFMS of the first embodiment.

FIG. 3 shows a block diagram of the ion trap drive 5 in the DIT-TOFMS of the first embodiment, and FIG. 2 shows a timing diagram showing the operation of the main part of the ion trap drive 5.

For instance, when trapping ions introduced into the ion trap 3 from the ion source 2, control signals on the positive and negative electrode sides are provided to the ion trap drive 5 from the control unit 1 that includes CPU and other components, and square-wave voltages generated according to those signals are applied to the ring electrode 31. The ion trap drive 5 comprises the positive electrode side switch 53, the negative electrode side switch 54, the positive electrode side high-voltage DC power supply 55, the negative electrode side high-voltage DC power supply 56 as well as two sets of variable delay circuits 51 and 52, the positive electrode side rectifying circuit 57, the negative electrode side rectifying circuit 58, two sets of integrating circuits 59 and 60 and the comparator circuit 61.

Figure 8:
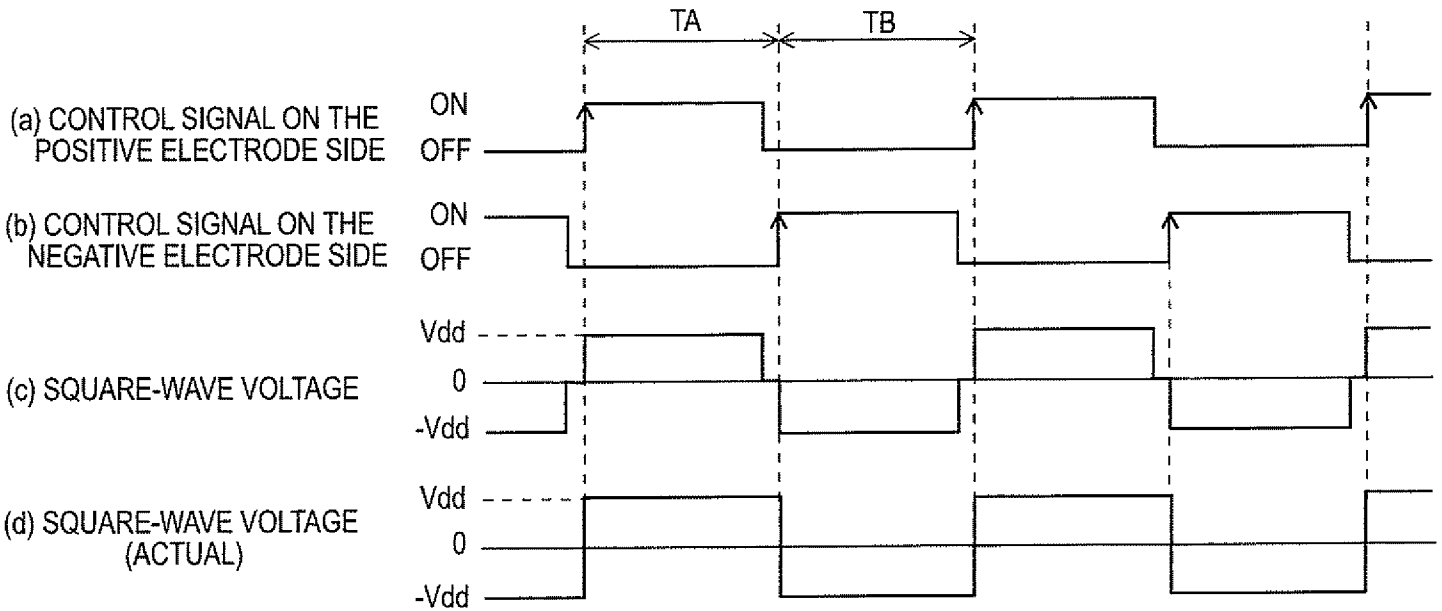
FIG. 8 shows a timing diagram showing the operation of the drive in the DIT in FIG. 6.
Figure 9A:
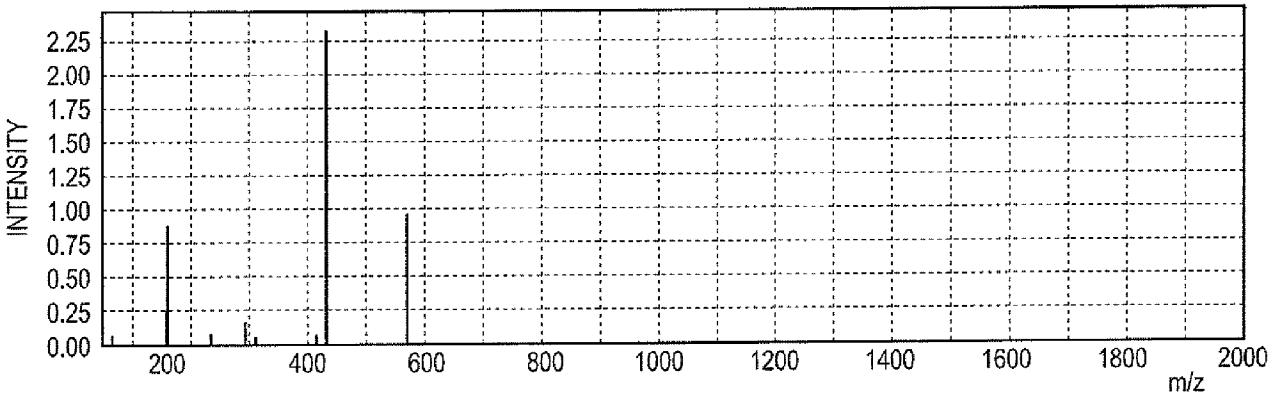
FIG. 9 shows a measured mass spectrum showing a problem in the case where the duty ratio of a square-wave voltage deviates from 50% in a conventional mass spectrometer.
Figure 9B:
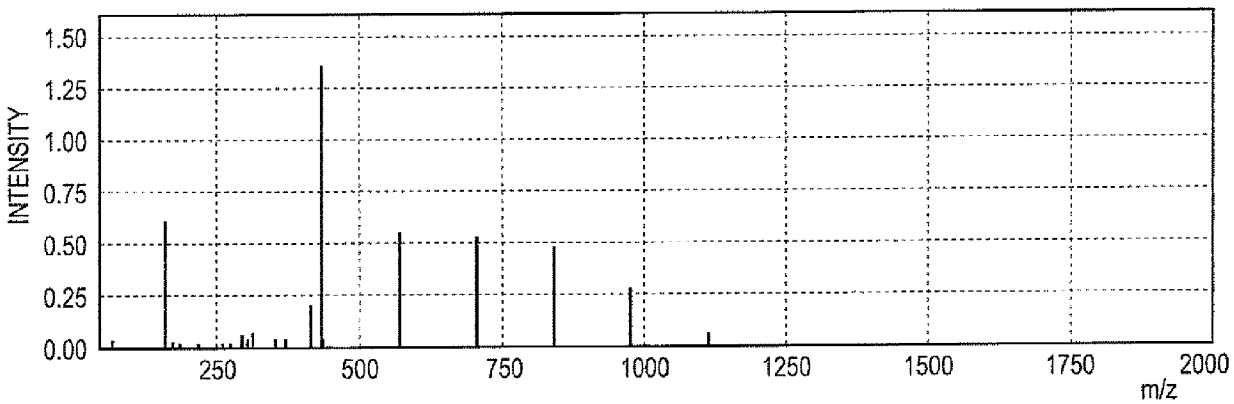
Figure 10:
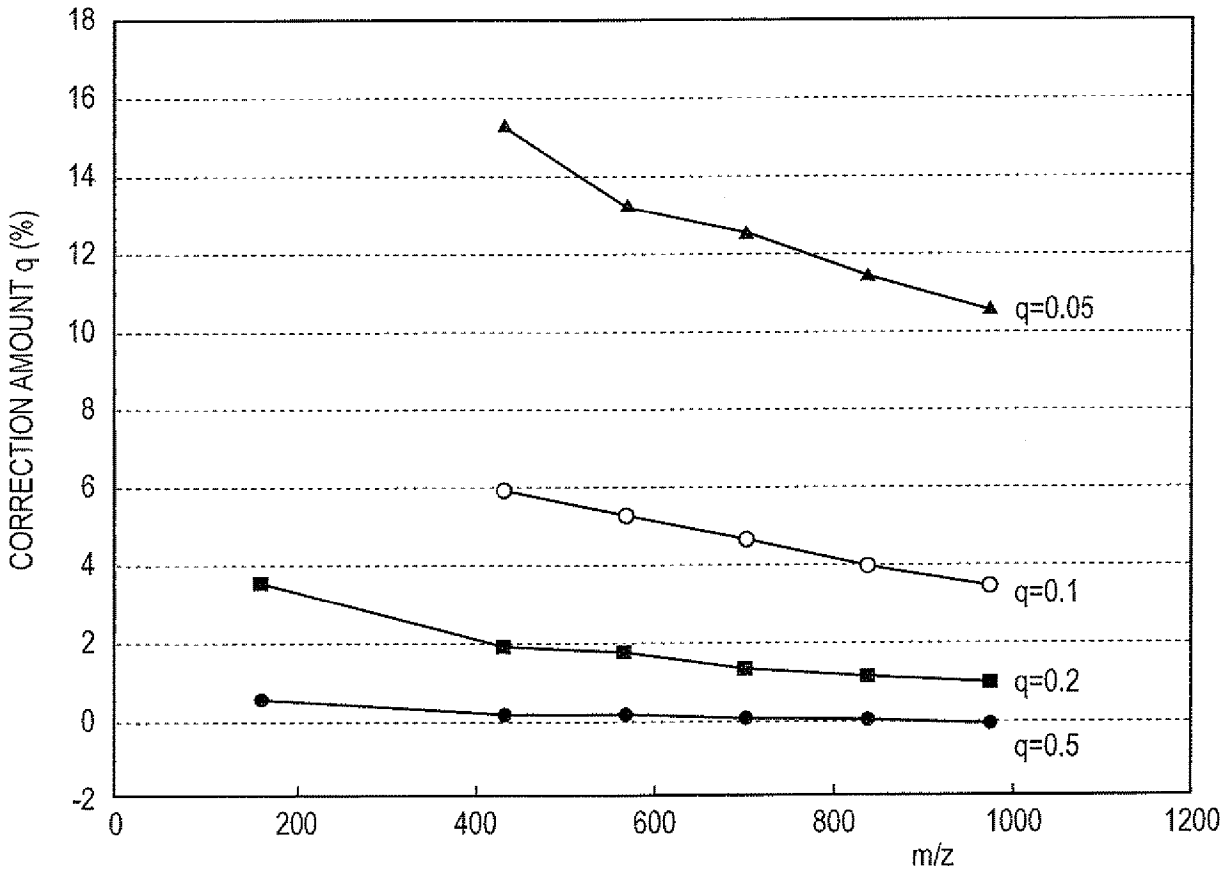
FIG. 10 shows the correction values of value q in the case where the duty ratio of a square-wave voltage is deviated by 0.3% from 50% in a conventional mass spectrometer.

The control signals on the positive and negative electrode sides are typical square-wave signals as shown in FIGS. 8 (*a*) and (*b*), and fixed amounts of delay are added to such control signals in the variable delay circuits 51 and 52, respectively. Although the amounts of delay added to both control signals are nominally zero or identical, said amounts of delay change in either the positive electrode side variable delay circuit 51 or the negative electrode side variable delay circuit 52 by feedback control as described below. Both control signals through the variable delay circuits 51 and 52 are provided to the positive electrode side switch 53 and the negative electrode side switch 54 and turn on or off those switches 53 and 54. When the positive electrode side switch 53 is on, a DC voltage on the positive electrode side whose voltage value output from the positive electrode side high-voltage DC power supply 55 is Vdd is applied to the ring electrode 31, and when the negative electrode side switch 54 is on, a DC voltage on the negative electrode side whose voltage value output from the negative electrode side high-voltage DC power supply 56 is −Vdd is applied to the ring electrode 31. That is, a square-wave voltage whose peak value on the positive electrode side is Vdd and whose peak value on the negative electrode side is −Vdd is applied to the ring electrode 31 (see FIG. 2 (*a*)).

The square-wave voltage referred to above is also supplied to the positive electrode side rectifying circuit 57 and the negative electrode side rectifying circuit 58, and the square-wave voltages on the positive and negative electrode sides are separately detected (see FIGS. 2 (*b*) and (*d*)). A signal separated from the positive electrode side is input to the positive electrode side integrating circuit 59 and smoothed, and becomes a positive DC signal that changes very slowly as shown in FIG. 2 (*c*). The magnitude (voltage value) h1 of this DC signal corresponds to the area of the square-wave voltage on the positive electrode side. Similarly, a signal separated from the negative electrode side is input to the negative electrode side integrating circuit 60 and smoothed, and becomes a negative DC signal that changes very slowly as shown in FIG. 2 (*e*), The magnitude (voltage value) h2 of this DC signal corresponds to the area of the square-wave voltage on the negative electrode side.

Two positive and negative DC signals obtained in the integrating circuits 59 and 60 are input to the comparator circuit 61, the magnitudes of said signals are compared, and a signal in proportion to the difference in such magnitudes, that is, the error signal Δ is output (see FIG. 2 (*f*)). If the areas of the square-wave voltage on the positive and negative electrode sides are identical, that is, the duty ratio of the square-wave voltage is 50%, the error signal Δ is zero. On the other hand, a nonzero error signal Δ means the deviation of the duty ratio of the square-wave voltage from 50%, the magnitude of the error signal Δ indicates an amount of deviation of the duty ratio and the polarity of the error signal Δ indicates the direction of deviation of the duty ratio (plus or minus direction with reference to 50%). Therefore, said error signal Δ is fed back to the variable delay circuits 51 and 52, and the variable delay circuits 51 and 52 adjust the amount of delay in proportion to the magnitude and polarity of the error signal Δ fed back to said variable delay circuits 51 and 52.

Qualitatively, when the area of a square-wave voltage on the positive electrode side is larger than that on the negative electrode side and the error signal Δ is positive, the amount of delay in the positive electrode side variable delay circuit 51 should be increased or the amount of delay in the negative electrode side variable delay circuit 52 should be decreased. As the result of this, the period TA in FIG. 8 becomes shorter and the period TB becomes longer accordingly at the inputs of the switches 53 and 54 and thus, the duty ratio changes in such a way that the area of the square-wave voltage on the negative electrode side is expanded. Conversely, when the area of a square-wave voltage on the negative electrode side is larger than that on the positive electrode side and the error signal Δ is negative, the amount of delay in the negative electrode side variable delay circuit 52 should be increased or the amount of delay in the positive electrode side variable delay circuit 51 should be decreased. As the result of this, the period TA in FIG. 8 becomes longer and the period TB becomes shorter accordingly at the inputs of the switches 53 and 54 and thus, the duty ratio changes in such way that the area of the square-wave voltage on the positive electrode side is expanded.

Feedback control may be carried out to the variable delay circuits 51 and 52 from the comparator circuit 61 in either digital or analogue fashion. In either way, the amount of delay may be changed in proportion to the magnitude of the error signal Δ obtained in the comparator circuit 61. As the relation between the error signal Δ and the appropriate amount of delay may be predetermined empirically, the manufacturer of this equipment can store such data in a memory at the time of shipping of said equipment. Alternatively, a method may be implemented that obtains the relation between the error signal Δ and the appropriate amount of delay by calibration.

Further, in many cases, the duty ratio of a square-wave voltage deviates from 50% due to change in environment such as ambient temperature. In general, therefore, it is not likely that the duty ratio will abruptly deviate too far from 50% in a short period of time. This means that the duty ratio changes very slowly in many cases. Therefore, feedback control may be employed that increases or decreases a fixed predetermined amount of delay when the error signal Δ exceeds a predetermined threshold value, instead of changing the amount of delay in proportion to the magnitude of the error signal Δ obtained in the comparator circuit 61. According to said control, even when the initial deviation of the duty ratio of a square-wave voltage is large, an optimal condition may gradually be achieved by applying feedback control repetitively.

In the configuration in FIG. 3, the error signal Δ is fed back to both the positive electrode side variable delay circuit 51 and the negative electrode side variable delay circuit 52. It can also be configured to fix the amount of delay in one of the variable delay circuits 51 and 52 (or without such delay circuit) and only change the amount of delay in the other variable delay circuit 51 or 52. That is, it suffices only to be able to change the relative phase relation between these control signals. For this purpose, it can also be configured to move the rising position of a control signal, instead of changing the amount of delay of the control signal itself. However, the configuration shown in the above embodiment is usually simpler and more convenient in terms of circuit design.

Figure 4:
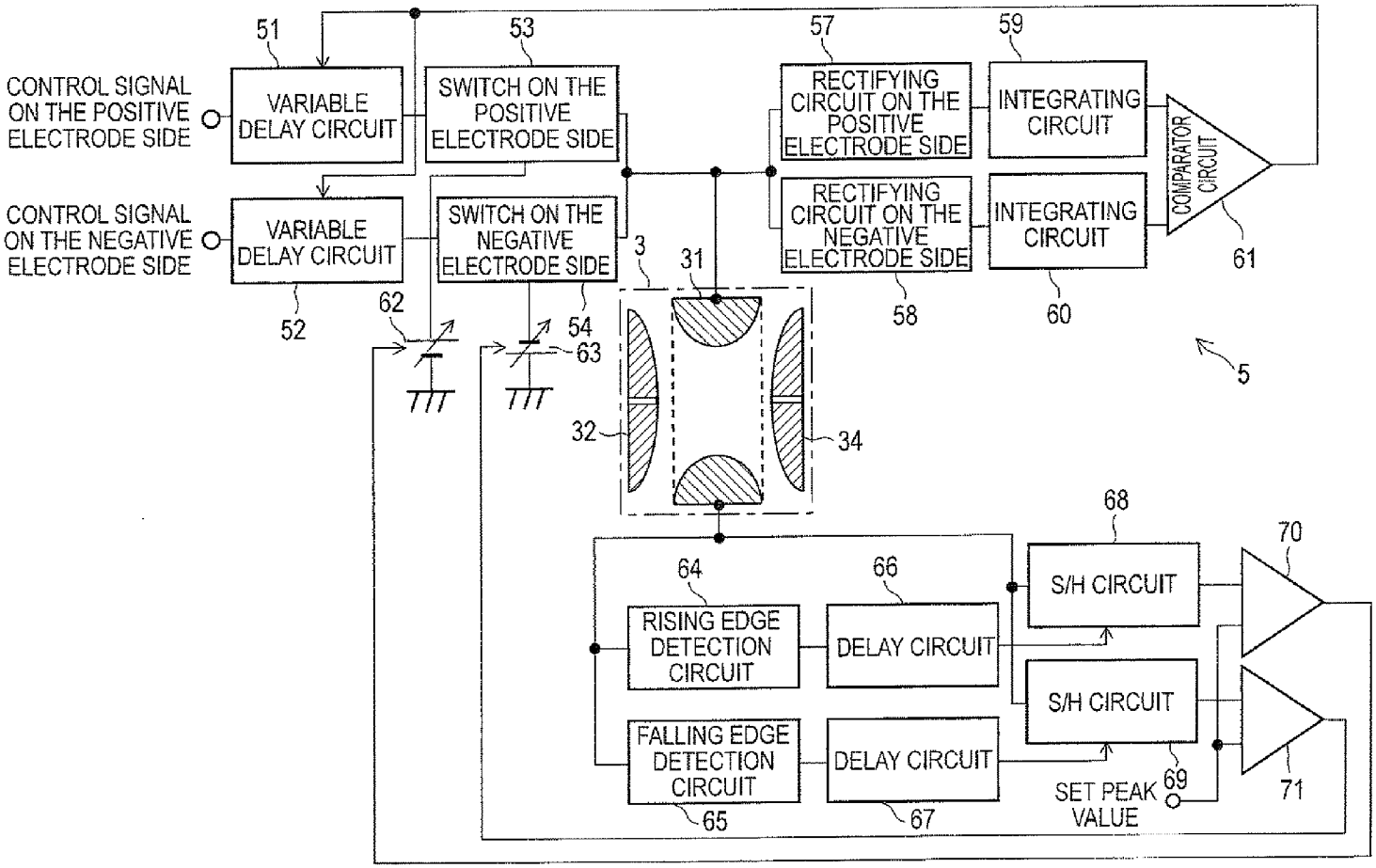
FIG. 4 shows a block diagram of the ion trap drive in the DIT-TOFMS, the second embodiment of the present invention.
Figure 5:
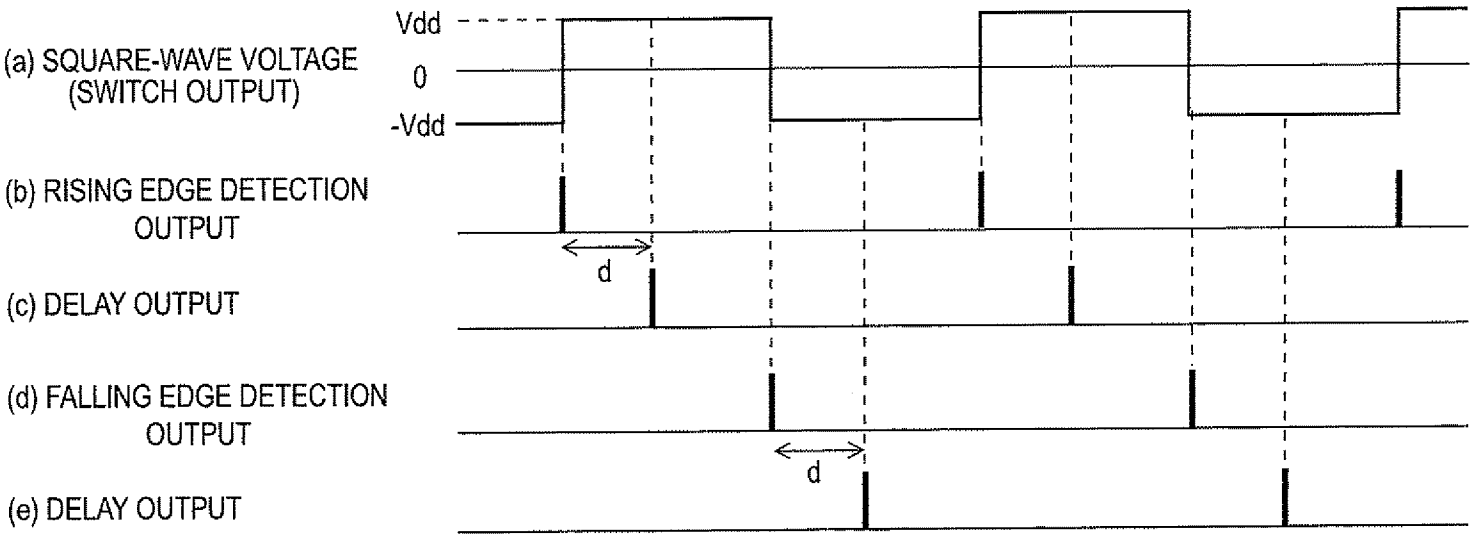
FIG. 5 shows a timing diagram showing the operation of the ion trap drive in the DIT-TOFMS of the second embodiment.

The configuration and operation of the ion trap drive in the DIT-TOFMS, the second embodiment of the present invention, is described next with reference to FIG. 4 and FIG. 5. FIG. 4 shows a block diagram of the ion trap drive in the DIT-TOFMS of the second embodiment, and the components used in the block diagram in FIG. 3 are marked with respective numbers. FIG. 5 depicts a timing diagram showing the operation of the main part of the ion trap drive in the DIT-TOFMS of the second embodiment.

The characteristics of the configuration of said ion trap drive 5 are that instead of the positive electrode side high-voltage DC power supply 55 and the negative electrode side high-voltage DC power supply 56 that output a predetermined DC voltage in the first embodiment referred to above, it is provided with the positive electrode side variable high-voltage DC power supply 62 and the negative electrode side Variable high-voltage DC power supply 63, respectively, and that a feedback control circuit is added that regulates the values of the output voltage (peak value) from said variable high-voltage DC power supplies 62 and 63.

More specifically, square-wave voltages applied to the ring electrode 31 are also input to the rising edge detection circuit 64, the falling edge detection circuit 65 and two sets of sample/hold (S/H) circuits 68 and 69. The rising edge detection circuit 64 detects the rising edge of a square-wave voltage and generates a pulse signal, and the positive electrode side delay circuit 66 delays said pulse signal by a fixed amount d (see FIGS. 5 (*b*) and (*c*)). Similarly, the falling edge detection circuit 65 detects the falling edge of a square-wave voltage and generates a pulse signal, and the negative electrode side delay circuit 67 delays said pulse signal by a fixed amount d (see FIGS. 5 (*d*) and (*e*)). This delay amount d is preset at a value which is approximately one-quarter of the period of the square-wave voltage.

The positive electrode side S/H circuit 68 samples a square-wave voltage at a pulse signal output from the positive electrode side delay circuit 66, and holds said value until the next sampling. The value of the square-wave voltage on the positive electrode side is thus firmly held. Similarly, the negative electrode side S/H circuit 69 samples a square-wave voltage at a pulse signal output from the negative electrode side delay circuit 67, and holds said value until the next sampling. The value of the square-wave voltage on the negative electrode side is thus firmly held. The output from the positive electrode side S/H circuit 68 is compared with the set peak value in the comparator circuit 70, and the error signal that corresponds to the difference is fed back to the positive electrode side variable high-voltage DC power supply 62. Further, the output from the negative electrode side S/H circuit 69 is compared with the set peak value in the comparator circuit 71, and the error signal that corresponds to the difference is fed back to the negative electrode side variable high-voltage DC power supply 63. The peak values are set, for instance, in the control unit 1 and set peak values with the same absolute value and different polarity such as Vdd and −Vdd are typically provided to the comparator circuits 70 and 71.

Accordingly, the output voltages from the positive electrode side variable high-voltage DC power supply 62 and the negative electrode side variable high-voltage DC power supply 63 are controlled by feedback so that they may achieve the respective set peak value. As described above, the duty ratio is controlled so that the areas of a square-wave voltage on the positive and negative electrode sides become identical under the condition that the absolute values of output voltages from the positive electrode side variable high-voltage DC power supply 62 and the negative electrode side variable high-voltage DC power supply 63 are identical and thus, the duty ratio is maintained at around 50%. In the configuration of the second embodiment, the duty ratio can be maintained at 50% with the peak values of square-wave voltages on the positive and negative electrode sides applied to a ring electrode being identical. This can improve the detection sensitivity in the high mass-to-charge ratio range and, at the same time, can control the deviation of mass calibration from the theoretical value.

Figure 6A:
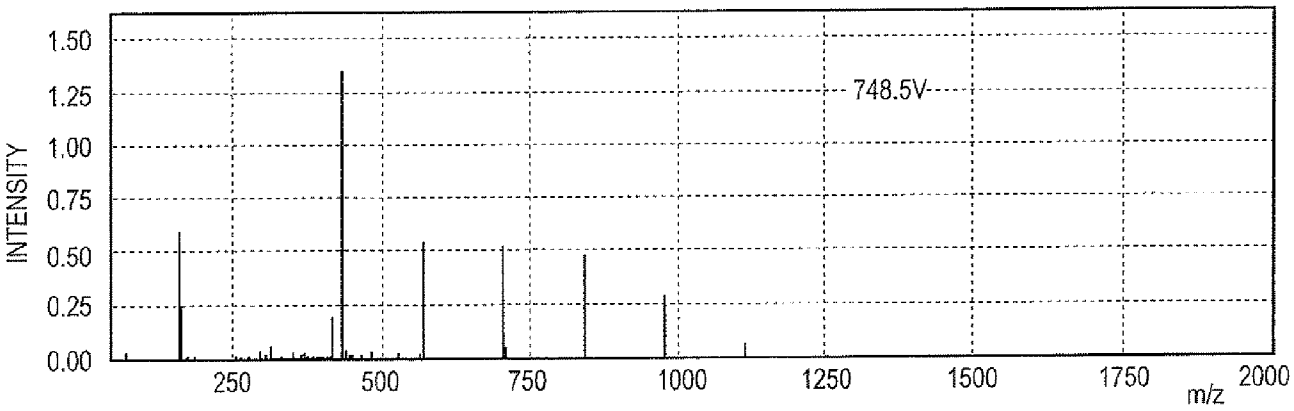
FIG. 6 shows a measured mass spectrum showing the sensitivity improvement in the high mass-to-charge ratio range for the DIT-TOFMS of the first embodiment.
Figure 6B:
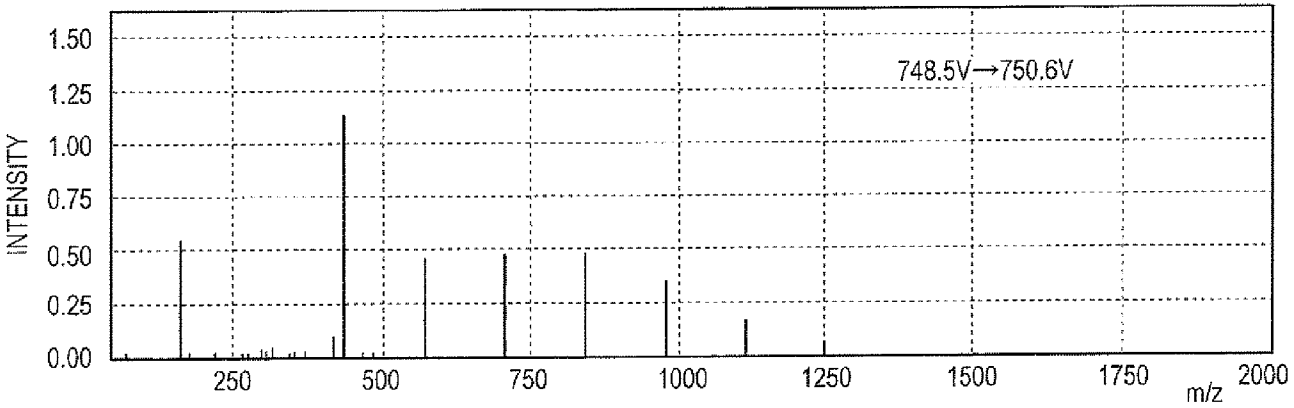
Figure 7:
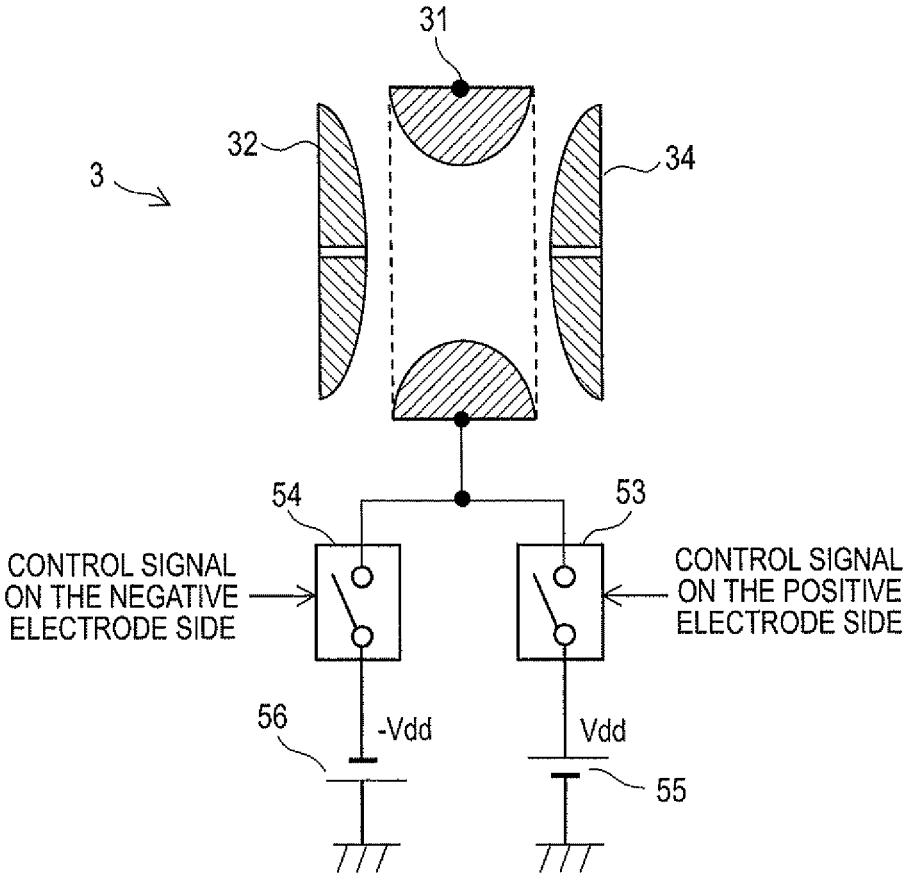
FIG. 7 shows a schematic view of the configuration of the drive in a conventional DIT.

As described above, a mass spectrometer using a conventional DIT cannot detect ions in the high mass-to-charge ratio range even if the duty ratio of a square-wave voltage is deviated only by 0.3% from 50%. In contrast to this, if a mass spectrum is obtained by adjusting one of the peak values so that the areas of a square-wave voltage on the positive and negative electrode sides may become identical, the mass spectrum in FIG. 6 (*a*) changes as shown in FIG. 6 (*b*). This shows the improvement of the detection sensitivity in the range of a mass-to-charge ratio of 1000 or more. In this case, the duty ratio is not 50%, but the areas of a square-wave voltage on the positive and negative electrode sides are identical as described in the embodiment referred to above. Therefore, it is plausible that the detection sensitivity in the high mass-to-charge ratio range is also improved when the areas of a square-wave voltage on the positive and negative electrode sides are equalized by maintaining the duty ratio at 50%. Also, in this case, the peak values of a square-wave voltage on the positive and negative electrode sides are slightly different. Even if the peak values are slightly different, it is found that the detection sensitivity in the high mass-to-charge ratio range may be improved if the areas of a square-wave voltage on the positive and negative electrode sides can be made identical.

In the embodiment referred to above, a 3D quadrupole ion trap is used as an ion trap. It is clear that the present invention may also be applied to an ion trap mass spectrometer using a linear ion trap capable of trapping ions on the same principle, and that the effect referred to above can be obtained.

DESCRIPTION OF THE NUMERICAL REFERENCES

1. Control unit
2. Ion source
3. Ion trap
3. Ring electrode
31. Ring electrode
32. Endcap electrode on the entrance side
33. Ion entrance aperture
34. Endcap electrode on the exit side
35. Ion exit aperture
4. Time-of-flight mass spectrometer
41. Flight space
42. Reflectron
43. Detector
5. Ion trap drive
51, 52. Variable delay circuit
53, 54. Switch
55, High-voltage DC power supply on the positive electrode side
56. High-voltage DC power supply on the negative electrode side
57, 58. Rectifying circuit
59, 60. Integrating circuit
61. Comparator circuit
62. Variable high-voltage DC power supply on the positive electrode side
63. Variable high-voltage DC power supply on the negative electrode side
64. Rising edge detection circuit
65. Falling edge detection circuit
66, 67. Delay circuit

68, 69. Sample/hold (S/H) circuit

70, 71. Comparator circuit

What is claimed is:

1. An ion trap mass spectrometer comprising:

an ion trap to confine ions in a space surrounded by three or more electrodes;

a positive voltage DC power supply;

a negative voltage DC power supply;

a switch on a positive electrode side that turns on and off the positive voltage output from said positive voltage DC power supply;

a switch on a negative electrode side that turns on and off the negative voltage output from said negative voltage DC power supply;

a square-wave voltage generation means for outputting a square-wave voltage to at least one of said electrodes by using the positive and negative voltages supplied through each of said switches on both positive and negative electrode sides when such switches are on, for trapping ions;

a positive electrode side waveform area calculation means for calculating the area of the square-wave voltage on the positive electrode side that is applied to at least one of said electrodes;

a negative electrode side waveform area calculation means for calculating the area of the square-wave voltage on the negative electrode side that is applied to at least one of said electrodes; and a feedback adjusting means for adjusting the timing of change of at least one of control signals that turn on and off said switches on the positive and negative electrode sides in order to level the areas calculated by said positive electrode side waveform area calculation means and negative electrode side waveform area calculation means.

2. The ion trap mass spectrometer according to claim 1, further comprising:

a peak value feedback adjusting means for adjusting voltages output from said positive and negative voltage DC power supplies by feedback so that peak values of said square-wave voltages on the positive and negative electrode sides become their respective predetermined value.

3. The ion trap mass spectrometer according to claim 1, wherein said positive electrode side waveform area calculation means and said negative electrode side waveform area calculation means respectively include a rectifying means for separating waveforms only on either positive or negative electrode side from a bipolar square waveform and an integrating means for integrating such separated square waveforms only on either the positive or negative electrode side, wherein said feedback adjusting means adjusts the timing of change of at least one of control signals that turn on and off said switches on the positive and negative electrode sides so that the difference of output between the two integrating means from the respective waveform area calculation means becomes zero.

* * * * *